United States Patent [19]

Morrison

[11] Patent Number: 4,723,924

[45] Date of Patent: Feb. 9, 1988

[54] RESOLDERABLE ELECTRICAL CONNECTOR

[75] Inventor: Robert A. Morrison, Long Beach, Calif.

[73] Assignee: Lockheed Corporation, Calabasas, Calif.

[21] Appl. No.: 935,991

[22] Filed: Nov. 28, 1986

[51] Int. Cl.[4] ..... H01R 4/02

[52] U.S. Cl. ..... 439/875

[58] Field of Search ..... 339/275 R, 275 B, 194 R; 219/85 CA; 439/874–876

[56] References Cited

U.S. PATENT DOCUMENTS

| | | | |
|---|---|---|---|
| 2,429,836 | 10/1947 | McFarlane | 339/194 R X |
| 2,759,161 | 8/1956 | Berg | 339/97 |
| 2,845,516 | 7/1958 | Jones | 339/275 R X |

*Primary Examiner*—Eugene F. Desmond

*Attorney, Agent, or Firm*—Louis L. Dachs

[57] ABSTRACT

The invention is an electrical connector assembly particularly suited for coupling or interfacing external wiring to the back plane of a circuit board housing. In detail, the invention comprises a first connector half having a first set of electrical contacts and a second connector half having a second set of electrical contacts. At least one of the first and second sets of electrical contacts is coated or tinned with solder. An integral heater is coupled to the first electrical connector for heating the solder to a temperature wherein the solder can be melted. Thus, the connector halves can be connected such that the first and second sets of electrical contacts are in contact. Thereafter, the contacts can be heated by applying electrical current to the heater so that the solder is reflowed. When the electrical power is terminated the solder solidifies, thus forming a continuous and air tight path between the first and second sets of contacts. To separate the connector halves, electrical power is again applied to the heater to reflow the solder and thereafter, the connector halves can be manually separated.

5 Claims, 6 Drawing Figures

FIG. 3
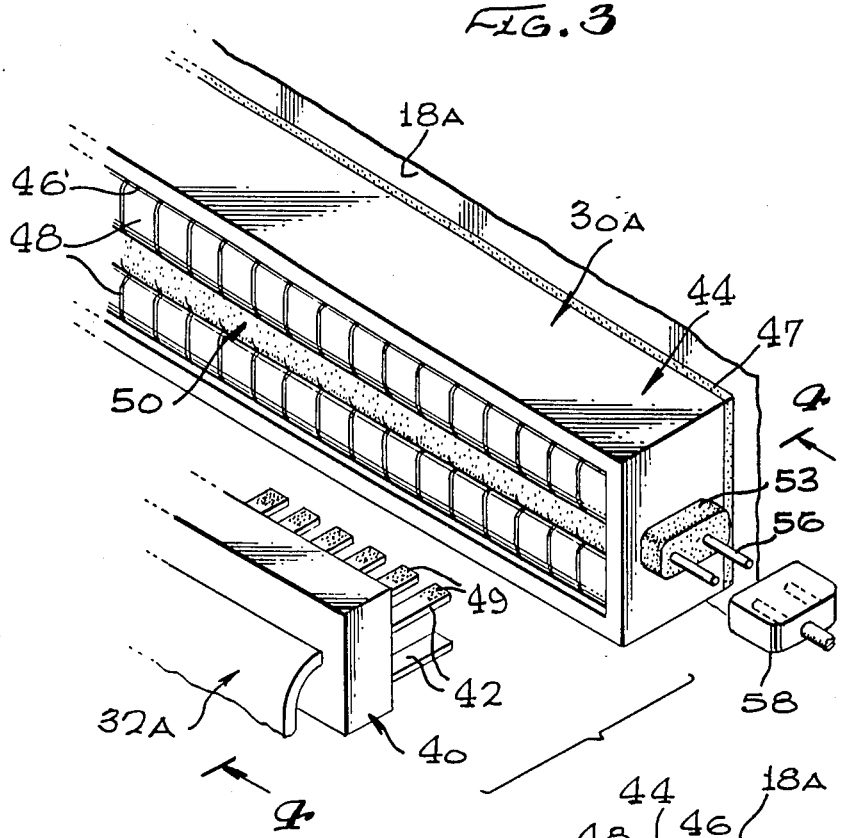
FIG. 5
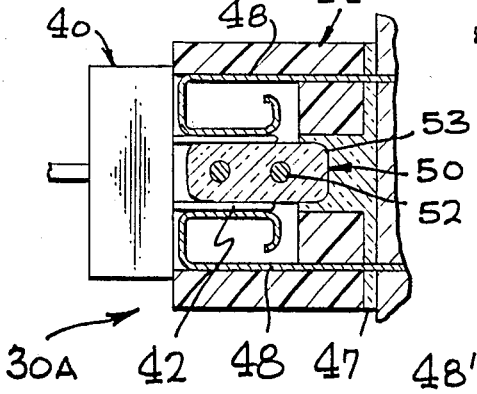
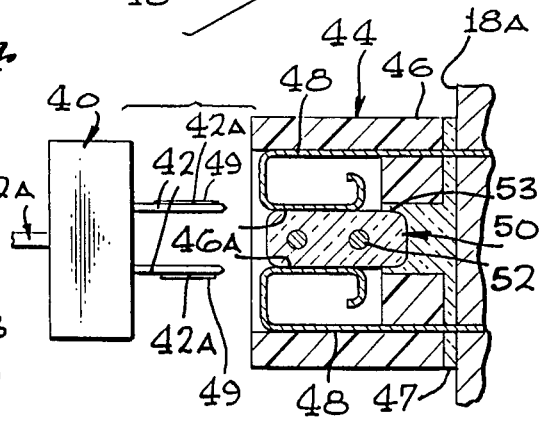
FIG. 4
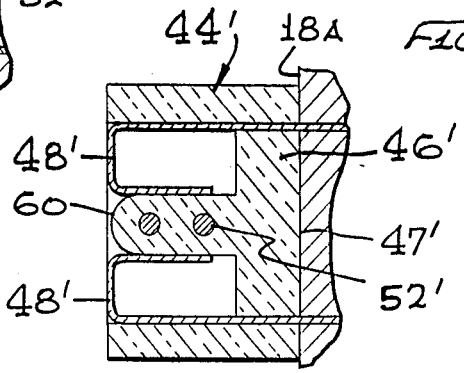
FIG. 6

RESOLDERABLE ELECTRICAL CONNECTOR

TECHNICAL FIELD

The invention relates to the field of electrical connectors and, in particular, to electrical connectors having integral heating means that can be used to solder the contacts of the connector together.

BACKGROUND INFORMATION

In recent years, connector technology has not kept pace with the solid state circuit technologies. As the solid state chips have become capable of supporting more and more complicated circuit patterns, the input-output densities, (i.e., the fine signal wires that are necessary to communicate one circuit chip to another, usually given in the number of input-output circuits per cubic inch) are also increasing exponentially. As the density of input-output circuits increase, the maintenance and parts damage percentage have gone up and connectors have now become one of the least reliable components within electronic subsystems.

To put the problem in perspective during the vacuum tube era where considerable power was required for the vacuum tubes, it was common practice to have the complete circuit subassembly serviced by a large cable with a relatively large connector with 1/16th inch diameter pins. With the advent of circuit compression through solid state electronics these requirements have now risen to a point where it is not uncommon for a single connector to have 150, 0.30 inch diameter contacts. With this high density of small pins, it is very easy to have one or more of the pins become deflected and/or mate improperly causing poor contact or making the connector unusable. This is why connector failures have become one of the dominate failure modes in avionics equipment.

The principal way of avoiding these pin chrunching connector joining operations is to use what is commonly called a zero insertion force (ZIF) connector. In this type of connector the pins and sockets are joined without any contact of the mating surfaces themselves so that very little insertion force is necessary. With the two halves joined, a latch or cam mechanism is operated to engage all of the contacts and complete the circuit. These ZIF connectors have become very popular and sometimes very exotic. An example of zero insertion force connectors can be found in U.S. Pat. No. 4,517,625 "Circuit Board Housing with Zero Insertion Force Connector" by A. Frink et al. But even these ZIF connectors rely on a spring force to maintain contact during the vibration and shock loads encountered during operation which limits reliability.

Furthermore, certain applications do not lend themselves to use of zero insertion force connectors. For example, in integrated circuit board racks the back planes, to which the numerous circuit boards are connected to, and are located deep within the mounting cabinet where activation of a ZIF connector is impractical.

The only required interfacing of back plane segments, in the past, was accomplished by using conventional connectors having hundreds of contacts, each a potential failure point. Existance of these potential points of failure resulted in a high risk condition and lowering of reliability of the back plane. An alternate method is to hard wire the back plane segments in place, but this has not been an acceptable alternative in many applications.

Furthermore, field repair would be a nightmare, for the technicians are not likely to be skilled in soldering techniques nor are proper soldering tools likely to not be available.

Thus, it is a primary object of the subject invention to provide an electrical connector that has increased reliability.

It is another primary object of the subject invention to provide an electrical connector that obtains the advantages of hard wiring while being easily separated.

A further object of the subject invention is to provide an electrical connector that is not subject to deterioration of the electrical contacts due to corrosion.

A still further object of the subject invention is to provide an electrical connector which substantially prevents the deteriorating of electrical contact with time.

Another object of the subject invention is to provide a method of mating contacts of electrical connectors that is not subject to contact separation due to vibrations, shock or accelerator loads.

DISCLOSURE OF THE INVENTION

The invention is an electrical connector assembly particularly suited for coupling or interfacing external wiring to the back plane and connecting segments of back planes of a circuit board housing. In detail, the invention comprises a first connector half having a first set of electrical contacts and a second connector half having a second set of electrical contacts. At least one of the first and second sets of electrical contacts is coated or tinned with solder. Integral heating means are coupled to the first electrical connector half for heating the solder to a temperature wherein the solder can be reflowed.

Thus, the connector halves can be such that the first and second sets of electrical contacts are in contact. Thereafter, the contacts can be heated by applying electrical current to the heating means so that the solder is reflowed. Thereafter, the electrical heater is terminated allowing the solder to solidify thus forming a continuous path between the first and second sets of contacts. To separate the connector halves, electrical power is again applied to the heating means to melt the solder and thereafter while warm the connector halves can be manually separated. Therefore, it is readily apparent that replacement of the back plane segment can be readily accomplished in the field by people unskilled in soldering techniques since an automatic electrical power supply designed to apply a specific current for a specific time can be used.

The heating means preferably are a resistance heater in the form of ceramic for having heating elements cast therein positioned within one of the connector halves. The resistance heater can be removable or permanently installed in one of the connector halves or the heating elements can be cast directly into the connector half housing if the housing or part thereof is made of insulating material of adequate temperature insensitivity.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

Illustrated in FIG. 1 is a perspective view of an integrated circuit board housing.

Illustrated in FIG. 2 is a partial cross sectional iew of the housing shown in FIG. 1 taken along the line 2—2.

Illustrated in FIG. 3 is an enlarged perspective view of a separated electrical connector for coupling external wiring to the back plane mounted in the housing.

Illustrated in FIG. 4 is a view of the connector assembly illustrated in FIG. 3 taken along the line 4—4 with the connector halves separated.

Illustrated in FIG. 5 is a cross-sectional view of the connector assembly similar to that illustrated in FIG. 4 but with the connector halves connected.

Illustrated in FIG. 6 is a cross-sectional view similar to FIG. 4, showing a second embodiment of the connector assembly.

BEST MODE FOR CARRYING OUT THE INVENTION

Figure 1:
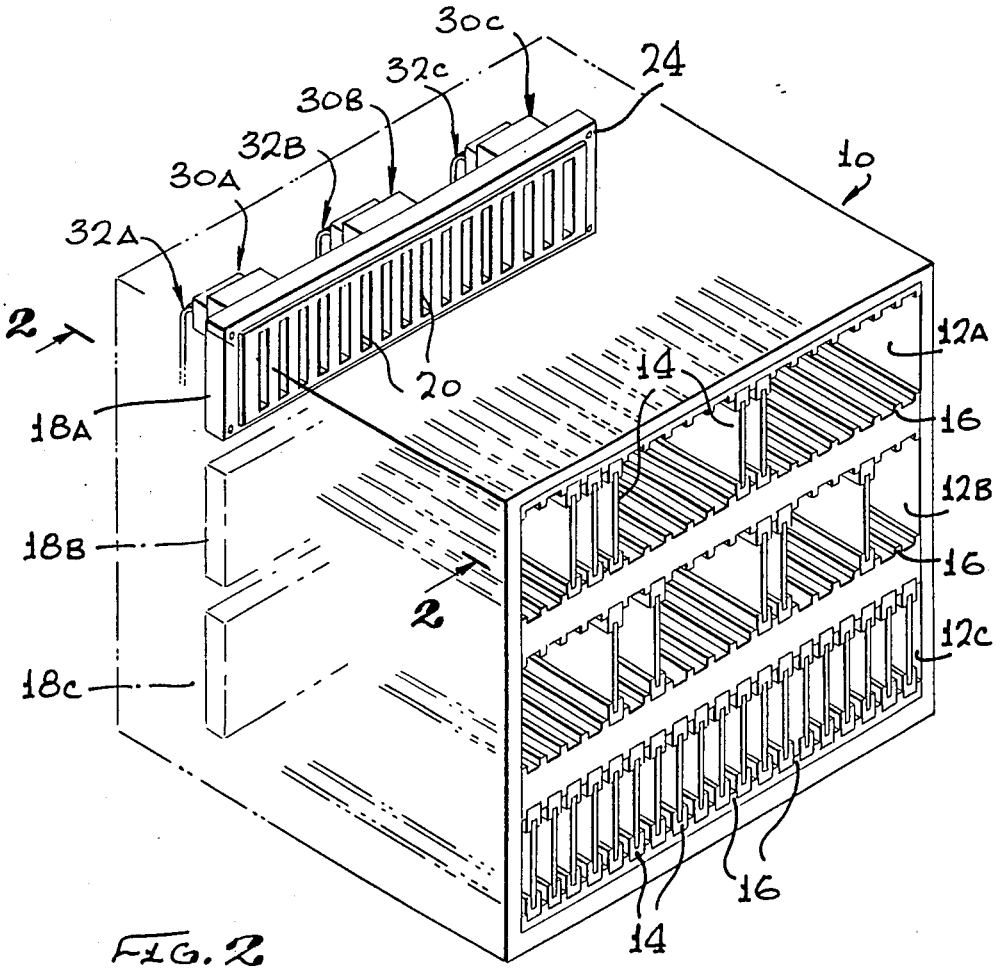
Figure 2:
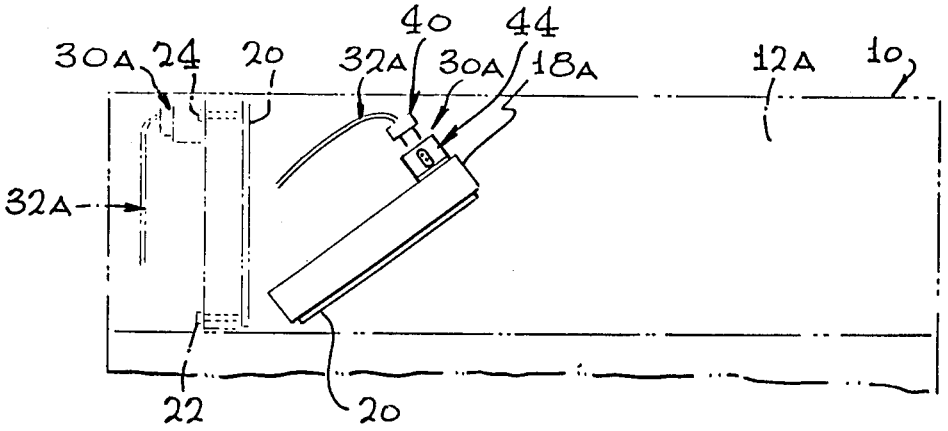

Illustrated in FIG. 1 is a perspective view of an electronic circuit board housing, generally designated by numeral 10, while illustrated in FIG. 2 is a partial cross-sectional view of the housing shown in FIG. 1 taken along the line 2—2. The housing 10 has three circuit board racks 12A, 12B and 12C in which numerous circuit boards 14 are shown mounted therein on tracks 16. The circuit boards 14 are coupled to back plane panels 18A, 18B and 18C by multiple contact connectors 20 mounted thereon and the back plane itself is fastened to supports 22 by means of fasteners 24. On the back plane 18A, (which is typical) are three identical connector assemblies 30A, 30B and 30C, coupling flat wire harnesses 32A, 32B and 32C respectively, thereto.

Illustrated in FIG. 3 is an enlarged perspective view of the connector assembly 30A while illustrated in FIGS. 4 and 5 are cross-sectional views of the connector 30A, shown in FIG. 3, is the separated condition and the connected condition, respectfully. This refers to FIGS. 1 and 2 and additionally to FIGS. 3–5, the connector assembly 30A consists of a connector half 40 having two rows or sets of contacts 42 which terminate the wires (not shown) in the flat wire cable 32A. The connector assembly 30A further includes a second connector half 44 which comprises a hollow housing 46 having a heat insulating back wall 47, mounted to the back plane 18A. The housing incorporates two rows or sets of spring-loaded contacts 48. The surface 42A of the contacts 42 and surface 48A of the contacts 48 are coated with a thin film of electrical solder. This is best seen in FIG. 3, wherein the contacts 42 are shown coated with a solder film 49. Alternately, just the contact set 42 or 48 alone may be coated Installed within the housing 46 of the connector half 44 is a resistance heater 50 supported by back wall 47. As illustrated, the resistance heater compresses a conductive heating element 52 embedded in a ceramic bar 53 with the heating elements terminating in external pins 56 (best seen in FIG. 3). As illustrated, the heater 50 is removable which can be accomplished by sliding it out the end of the housing 46. This approach saves weight and cost if one heater is needed for the whole rack. Of course, it must be noted that the heater 50 could be permanently installed by bonding the ceramic bar 53 in place or by use of conventional fastening means (not shown). The pins 56 can be coupled to an external power supply not shown (having a mating connector 58 which is illustrated). Preferably, the power supply would have a timer and be specifically designed to apply the proper amount of heat such that as to melt the solder in a short period of time so the connector halves can be separated or joined as needed.

It must be understood that the connector half 44 could be made out of an insulating material such as a ceramic with the heating wires or elements cast therein. This approach is illustrated in FIG. 6 wherein a one-piece connector half 44' generally similar in cross-sections to the connector 44 shown in FIG. 3. Here the connector half 44' includes a one-piece housing 46' made of a suitable electrically insulating material, such as a ceramic, with an integral back wall 47' having a protrusion 60 extending therefrom. The protrusion 60 incorporates a heating element 52 similar to heating element 52. As in the previous example, the spring loaded contacts 48' are close or in contact with protrusion 60. Here the heater is the protrusion 60 with heating elements 52 therein.

While the invention has been described with reference to a particular embodiment, it should be understood that the embodiment are merely illustrative as there are numerous variations and modifications which may be made by those skilled in the art. Thus, the invention is to be construed as being limited only by the spirit and scope of the appended claims.

INDUSTRIAL APPLICABILITY

The invention has applicability to all electrical systems which have components that must be periodically separated.

I claim:

1. An electrical connector assembly comprising:

a female connector half having a first set of spring loaded electrical contacts;

a male connector half having a second set of electrical contacts for contacting said first set of electrical contacts when said male and female connector halves are mated;

a solder coating on at least one of said first and second sets of electrical contacts; and integral heating means coupled to one of said electrical connector halves for heating said solder to a temperature wherein said solder is melted;

such that, when said connector halves are connected and said first set of electrical contacts is in contact with said second set of said electrical contacts, power can be applied to said heating means to melt said solder coating and thereafter said electrical power can be removed allowing said solder to solidify thereby forming a continuous solder joint between said first and second sets of electrical contacts.

2. The connector assembly of claim 1 wherein said heating means is coupled to said female connector half.

3. The connector assembly of claim 2 wherein said heating means is a resistance heater.

4. The connector assembly of claim 3 wherein said resistance heater is removably mounted in said female connector half.

5. The connector assembly of claim 3 wherein at least a portion of said female connector half is made of non-electrically conductive material and said resistance heater is integral with said at least a portion of said female connector half.

* * * * *